US006516695B2

(12) United States Patent
Cassoni et al.

(10) Patent No.: US 6,516,695 B2
(45) **Date of Patent: *Feb. 11, 2003**

(54) DEVICE AND METHOD FOR TRIMMING PRINTED PRODUCTS

(75) Inventors: Robert Paul Cassoni, Centerville, OH (US); John Lawrence Herman, Huber Heights, OH (US)

(73) Assignee: Heidelberger Druckmashcinen AG, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/448,986

(22) Filed: Nov. 24, 1999

(65) Prior Publication Data

US 2002/0035907 A1 Mar. 28, 2002

(51) Int. Cl.[7] ..... B26D 7/06; B26D 5/22; B26D 7/02

(52) U.S. Cl. ..... 83/213; 83/222; 83/227; 83/229; 83/255; 83/272; 83/277; 83/280; 83/404.1

(58) Field of Search ..... 83/934, 213, 222, 83/255, 256, 272, 225, 226, 227, 228, 229, 230, 266, 277, 279, 280, 404.1, 404.2, 404.3, 404.4; 198/441, 470.1

(56) References Cited

U.S. PATENT DOCUMENTS

| | | | | | |
|---|---|---|---|---|---|
| 2,017,462 | A | * | 10/1935 | Kleineberg | 83/934 X |
| 3,250,162 | A | * | 5/1966 | Bunting | 83/255 X |
| 3,603,191 | A | * | 9/1971 | Muller et al. | 83/256 X |
| 3,733,947 | A | * | 5/1973 | Bryson et al. | 83/280 |
| 3,811,350 | A | | 5/1974 | Marciniak | 83/39 |
| 4,038,893 | A | * | 8/1977 | Reist | 83/154 |
| 4,615,249 | A | * | 10/1986 | Geiser | 83/934 X |
| 4,721,296 | A | * | 1/1988 | Mowry | 270/52.2 |
| 5,113,731 | A | * | 5/1992 | Reist | 83/404.2 X |
| 5,503,051 | A | * | 4/1996 | Stauber | 83/934 X |
| 5,715,737 | A | * | 2/1998 | Stauber et al. | 83/404.1 X |

* cited by examiner

*Primary Examiner*—Charles Goodman
(74) *Attorney, Agent, or Firm*—Davidson, Davidson & Kappel, LLC

(57) ABSTRACT

A device for trimming multiple streams of printed products including a first trimming unit for trimming at least one side of a first stream of printed products, and a second trimming unit for trimming at least one side of a second stream of printed products, the first stream and the second stream having a similar direction. Also disclosed is a method for trimming multiple streams of printed products comprising moving a first stream of printed products in a first direction, trimming at least one side of the first stream, moving a second stream of printed products separate from the first stream in a direction similar to the first direction, and trimming at least one side of the second stream.

18 Claims, 3 Drawing Sheets

DEVICE AND METHOD FOR TRIMMING PRINTED PRODUCTS

BACKGROUND OF THE INVENTION

1. Field of the Invention

The present invention relates generally to printing presses and more particularly to a device and method for trimming printed products.

2. Background Information

Web printing presses print a continuous web of material, such as paper. The continuous web then is cut in a cutting unit so as to form book blocks. These book blocks can be sections of a newspaper, for example. These book blocks typically require further processing, including the trimming of edges, so that uniform and straight edges result. To perform a trimming operation, it is often desirable to slow the product stream. This may be accomplished by splitting the product stream and then to decelerating the resultant split product streams. This often requires a large amount of floor space.

U.S. Pat. No. 3,811,350 discloses a sheet material trimming method and apparatus, in which sheet material is transferred by a conveyor belt to a first trimming station where a face edge of the sheet material is trimmed. The sheet material is then transferred to a second trimming station where the head and trail edges are trimmed. The knife assemblies may be operated by a crank drive.

This device has the disadvantage that only a single stream of products is processed. Moreover, the drives disclosed for the various knives are complicated.

BRIEF SUMMARY OF THE INVENTION

An object of the present invention is to provide for a device and method for trimming printed products in a simplified manner. An additional or alternative object of the present invention is to be able to trim multiple product streams in a coordinated fashion.

The present invention provides a device for trimming multiple streams of printed products including a first trimming unit for trimming at least one side of a first stream of printed products and a second trimming unit for trimming at least one side of a second stream of printed products. The first stream and the second stream having a similar direction. By trimming two separate streams moving in a similar direction, the throughput of the trimmer may be increased.

The device preferably has a common drive unit, the first and second trimming units being connected to and driven by the common drive unit. The common drive unit simplifies timing of the cuts of the trimming units. The common drive unit may include a central drive shaft.

The device may further include a third trimming unit for trimming at least one side of a third stream of printed products and a fourth trimming unit for trimming at least one side of a second stream of printed products. The first stream, the second stream, the third stream and the fourth stream have a similar direction. The common drive unit may then be connected to and drive the first, second, third and fourth trimming units. The first, second, third and fourth trimming units preferably define a circle, with the common drive unit being located centrally in the circle.

The first stream and the second stream preferably move in parallel.

Another trimming unit for trimming at least one further side of the first stream may be provided.

The first trimming unit may include a blade, a blade support, and two rods fixedly connected to the blade support, with the two rods being connected to a drive unit. Ink jet station for the product streams may be provided to add further printing, for example addresses or names, to the printed products.

A common frame may support the first and second trimming units.

The present invention also provides a method for trimming multiple streams of printed products including the steps of moving a first stream of printed products in a first direction, trimming at least one side of the first stream, moving a second stream of printed products separate from the first stream in a direction similar to the first direction, and trimming at least one side of the second stream.

The first stream and the second stream preferably are moved in parallel. The streams also preferably are moved in an indexed manner through the trimmer.

BRIEF DESCRIPTION OF THE DRAWINGS

One preferred embodiments of the present invention is described below by reference to the following drawings, in which.

DETAILED DESCRIPTION

Figure 1:
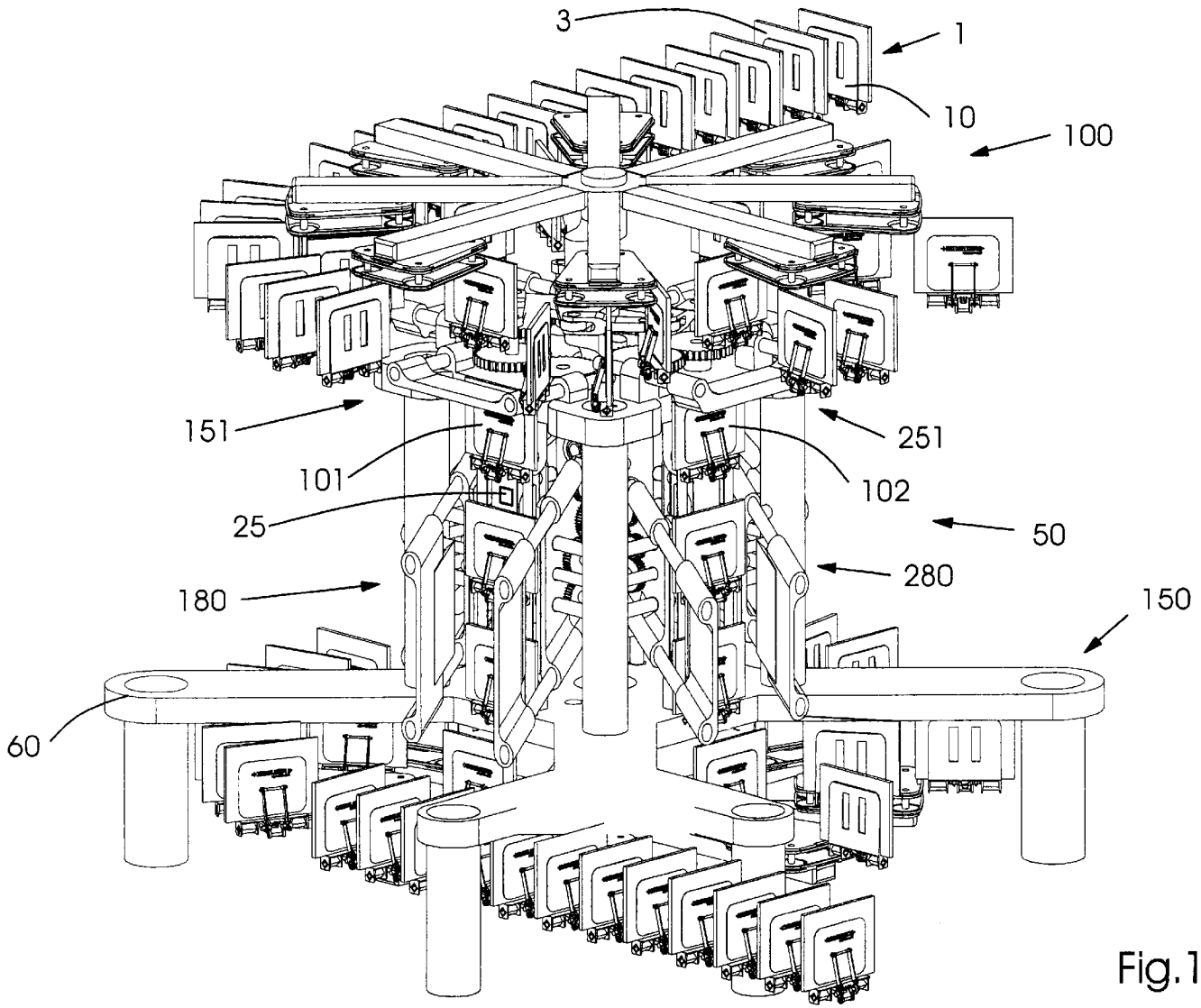
FIG. 1 shows a top perspective view of the trimmer of the present invention.

FIG. 1 shows a perspective view of an embodiment of the present invention. A product stream 1 of individual book blocks 3 enters splitting device 100. Each of the book blocks is held in an individual gripper device 10, which is attached on an outer side to a track (not shown). The individual gripper devices 10 can be driven in the track by, for example, a chain drive.

Figure 2:
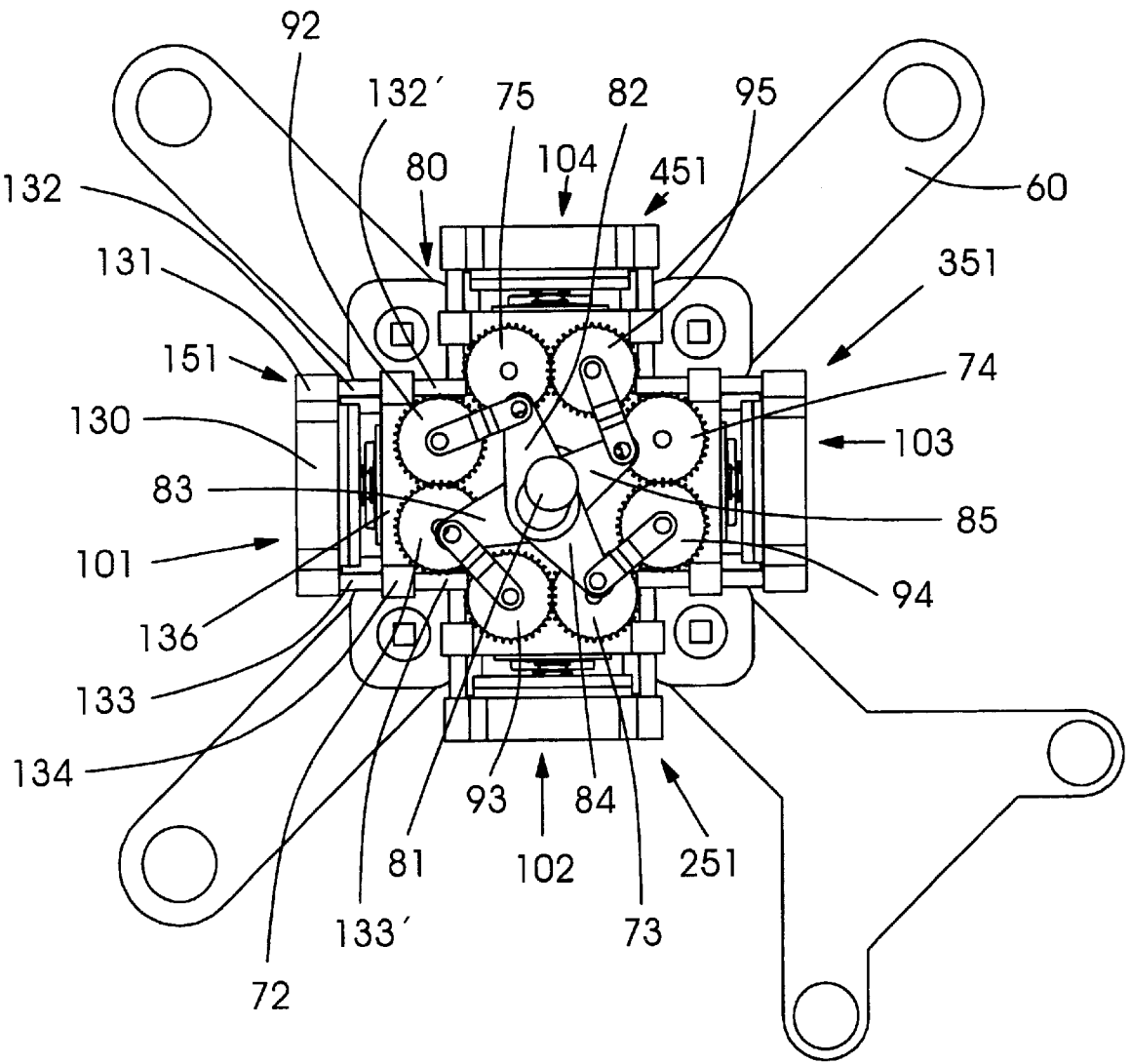
FIG. 2 shows a top view of th e trimmer of the present invention showing face edge trimming units interconnected by a common drive.

Splitting device 100 splits the product stream 1 into four parallel substreams all moving in a downward direction, including substream 101, substream 102, substream 103 (FIG. 2), and substream 104 (FIG. 2). Splitting device 100 may be similar to that disclosed in U.S. patent application Ser. No. 09/499,133, entitled "Device and Method for Splitting a Printed Product Stream" filed on Nov. 24, 1999, which application is hereby incorporated by reference herein.

Once split into the substreams, the products are trimmed in a trimmer 50. Trimmer 50 includes a face edge trimming unit 151 and a lead and trail edge trimming unit 180 for the first substream 101. Trimmer 50 also includes a face edge trimming unit 251 and a lead and trail edge trimming unit 280 for the second substream 102, as well as trimming units for the third and fourth substreams.

After the products are trimmed, the product stream is reconstituted in a substream fusion section 150. By splitting the streams into four substreams, performing trimming operations on the four substreams and reconstituting the product stream, the trimmer provides excellent throughput.

In addition to the trimming units, an ink jet station 25 can be attached to frame 60 to ink jet, for example, addresses, onto the printed products in substream 101. Each substream may be provided with a similar ink jet station.

FIG. 2 shows a top view of trimmer 50, which has a base 60. Four substreams 101, 102, 103 and 104 are processed by trimmer 50. Each of the substreams 101, 102, 103 and 104 is first trimmed by face edge trimming units 151, 251, 351 and 451, respectively. Face edge trimming unit 151 includes a blade 130 located on a blade support 131. Blade support 131 is attached fixedly at both ends to arms 132 and 133.

Arms 132 and 133 are slidingly supported in a rod support 134. The ends 132' and 133' of rods 132 and 133 located away from blade support 131 are toothed and geared to a central drive unit 80. Central drive unit 80 includes a central drive shaft 81 which drives arms 82, 83, 84 and 85, so that these arms rotate wheels 92, 93, 94 and 95, respectively, in a back and forth (clockwise/counterclockwise) motion. The rotation of wheels 92, 93, 94 and 95 also causes wheels 72, 73, 74 and 75 to rotate in a counter direction.

Thus the counterclockwise rotation of central drive shaft 81 causes 82 to move, so that wheel 92 first rotates clockwise. Wheel 92 is geared to wheel 72 and rod 132, and thus the clockwise rotation of wheel 92 causes wheel 72 to rotate counterclockwise. Wheel 72 is geared to rod 133. The simultaneous clockwise movement of wheel 92 and counterclockwise movement of wheel 72 cause rods 132 and 133 to move inwardly toward center drive shaft 81. Blade 130 on support 131 is thus moved inwardly so that blade 130 passes closely by a bottom knife 136 on support 134. Blade 130 thus trims a face edge of a book block moving in substream 101.

As the central drive shaft 81 rotates further, arm 82 rotates wheel 92 in the opposite direction, i.e. counterclockwise, thus moving the blade to a disengaged position as shown in FIG. 2.

Trimming units 251, 351 and 451 also have blade, support and rod arrangements similar to blade 130, support 131 and rods 132 and 133. Arms 83, 84 and 85 drive wheels 93, 94 and 95, respectively, which in turn drive wheels 73, 74 and 75, respectively. As the central drive shaft 81 rotates, the blades in trimming units 251, 351 and 451 sequentially trim the face edges in substreams 102, 103 and 104, respectively.

Figure 3:
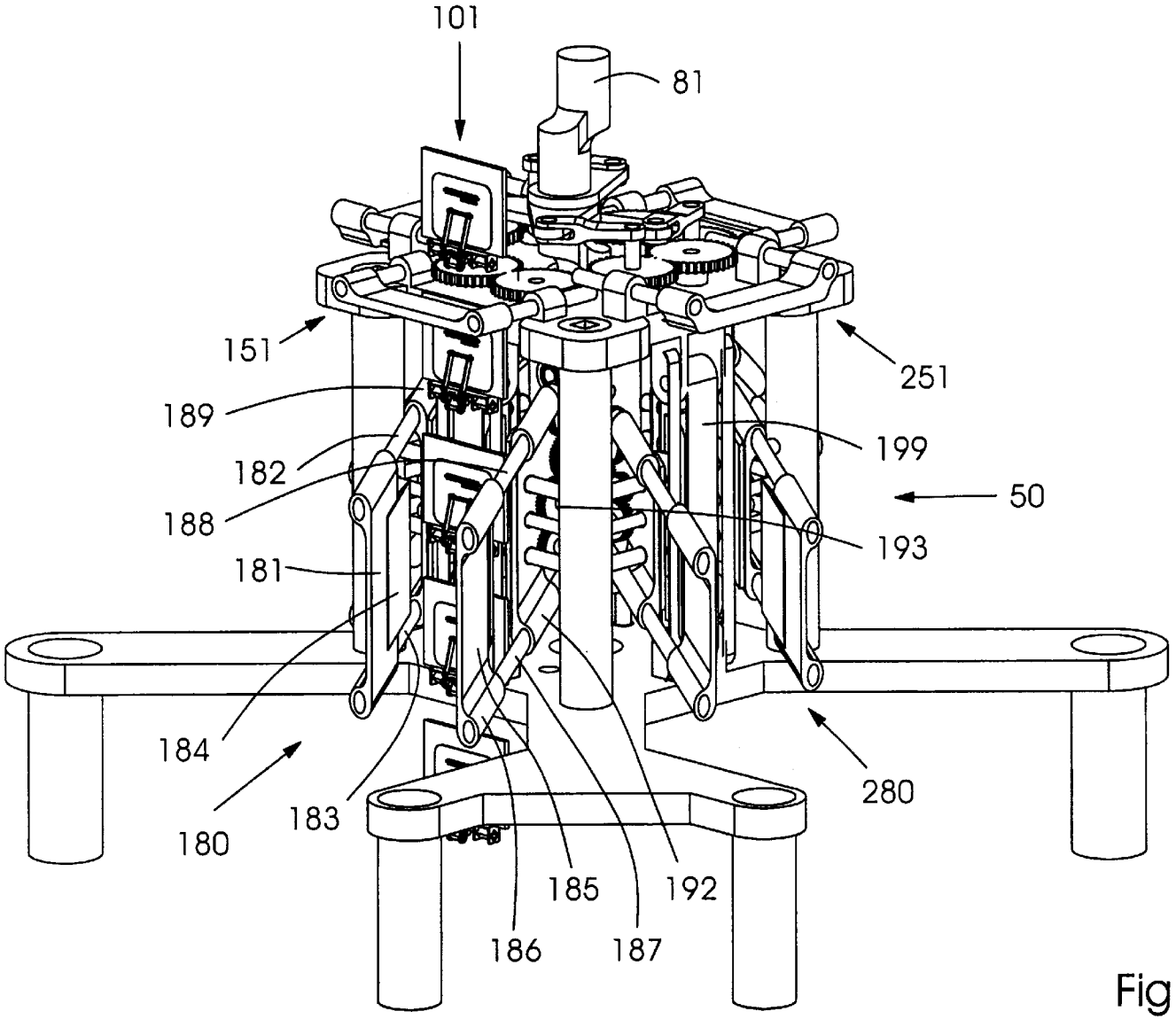
FIG. 3 shows a more detailed view of the trimmer of the present invention.

FIG. 3 shows a perspective view of the trimmer 50, and shows in detail the lead and trail edge trimming units 180 and 280. Substream 101 moves downwardly through trimming unit 151 and then through lead and trail edge trimming unit 180. Lead and trail edge trimming unit 180 includes a trail blade support 181 on which a blade 184 is supported. Blade support 181 is fixedly attached to ends of two rods 182 and 183, which are toothed at their other ends. Rods 182 and 183 are supported in rod support 189, and are driven by a gear assembly 193 which is geared to central drive shaft 81.

Lead and trail edge trimming unit 180 also includes a lead blade support 186 on which a lead blade 185 is supported. Lead blade support 186 is fixedly attached to two rods 187 and 188, which are slidingly supported in support 192 and are geared to gear assembly 193.

As the book blocks in substream 101 exit face edge trimming unit 151, they are trimmed on their lead and trail edges by lead and trail edge trimming unit 180. The gear assembly 193 is geared to drive shaft 81, and operates similarly to the gearing for the trimming unit 151, in that the blades 184 and 185 on supports 181 and 186 move in a reciprocating motion to pass by bottom knives on supports 189 and 192, respectively.

Substream 102 (FIG. 2) is likewise processed after trimming unit 251 by lead and trail edge trimming unit 280. Substreams 103 and 104 are also processed in a similar manner. Trimming units 180 and 280 preferably apply their cuts at approximately a 45 degree angle, which aids trim quality.

The products are moved in each substream in an indexed manner, so that the products are released from the belt drive and clamped before the first trimming step, then indexed down further to the next trimming station. The belt drive for the substreams of the products is connected directly to the central drive unit and may be for example, a Geneva-type indexing device. Each belt drive may drive the substream out-of-phase, preferably 90 degrees, with the adjacent substreams. FIG. 3 shows, for example, indexed belt drive 199 for substream 192 (FIG. 2).

Once the products are trimmed, the book blocks exit the trimmer 50 and are reconstituted as a single stream.

In addition to the rack and spur gearing (wheels 92,72) shown in the figures, the arms connected to the drive shaft 81 could also be connected to the blades directly. A clutch could be provided for each trimmer module to permit disengagement to allow for maintenance while the other trimmer modules are running.

More than four substreams could also be possible. A ball screw or other positioning device could be used to alter the book width, and also to alter the front face cut.

The individual gripper devices 10 shown in FIG. 1 may be the same as those disclosed in the co-pending U.S. patent application Ser. No. 09/448,990 entitled "Recycled Pocket System" filed on Nov. 24, 1999, which application is hereby incorporated by reference herein.

What is claimed is:

1. A device for trimming multiple streams of products comprising:

a stationary base defining a vertical axis;

a non-rotating first trimming unit arranged at a first angle defining a zero angle position about the axis for trimming at least one side of a first stream of printed products moving in a direction parallel to the axis, the first trimming unit having a first support fixed with respect to the stationary base and a first blade movable radially with respect to the axis; and a non-rotating second trimming unit arranged at a second angle different from the first angle about the axis with respect to the first trimming unit for trimming at least one side of a second stream of printed products, the second stream moving in a direction parallel to the axis, the second trimming unit having a second support fixed with respect to the stationary base and a second blade movable radially with respect to the axis.

2. The device as recited in claim 1 further comprising a common drive unit, the first and second trimming units being connected to and driven by the common drive unit.

3. The device as recited in claim 2 wherein the common drive unit includes a central drive shaft.

4. The device as recited in claim 1 further comprising a third trimming unit arranged at a further angle about the axis with respect to the first and second trimming units for trimming at least one side of a third stream of printed products; and a fourth trimming unit arranged at another angle about the axis for trimming at least one side of a fourth stream of printed products, the first stream, the second stream, the third stream and the fourth stream having a similar direction.

5. A device as recited in claim 4 further comprising a common drive unit, the common drive unit being connected to and driving the first, second, third and fourth trimming units.

6. The device as recited in claim 5 wherein the first, second, third and fourth trimming units define a circle, the common drive unit being located centrally in the circle.

7. The device as recited in claim 6 wherein the common drive unit includes a central drive shaft.

8. The device as recited in claim 1 wherein the second angle is at a 90 degree position.

9. The device as recited in claim 1 further comprising another trimming unit in series with the first trimming unit for trimming at least one further side of the first stream, the other trimming unit having another support and another blade movable radially with respect to the axis.

10. The device as recited in claim 9 wherein the other blade is at a ninety degree angle to the first blade.

11. The device as recited in claim 1 wherein the first trimming unit further includes two rods fixedly connected to the first support.

12. The device as recited in claim 11 wherein the two rods are connected to a drive unit.

13. The device as recited in claim 1 further comprising a common frame, the frame supporting the first and second trimming units.

14. The device as recited in claim 1 wherein the first and second streams move in a downward direction.

15. The device as recited in claim 1 further comprising a rotating means for splitting a primary stream of the printed products into the first and second streams.

16. The device as recited in claim 1 further comprising individual gripper devices gripping the printed products.

17. The device as recited in claim 1 wherein the multiple streams of products are arranged about the axis evenly.

18. A device for trimming multiple streams of printed products comprising:

a stationary base;

a rotating splitting device rotating with respect to the stationary base about an axis, the rotating splitting device accepting printed products rotating and splitting the printed products into a first stream and a second stream, the axis being vertical and the first and second streams moving in a vertical direction;

a non-rotating first trimming unit arranged at a first angle with respect to the axis defining a zero angle position for trimming at least one side of the first stream, the first trimming unit having a first support fixed with respect to the stationary base and a first blade movable radially with respect to the axis; and a non-rotating unit arranged at a second angle different from the first angle about the axis with respect to the first trimming unit for trimming at least one side of the second stream, the second trimming unit having a second support fixed with respect to the stationary base and a second blade movable radially with respect to the axis.

* * * * *